United States Patent [19]

Freeman

[11] Patent Number: 4,587,164

[45] Date of Patent: May 6, 1986

[54] ROOF DECK COMPOSITE PANELS

[75] Inventor: Thurman W. Freeman, Newark, Ohio

[73] Assignee: The Dow Chemical Company, Midland, Mich.

[21] Appl. No.: 728,413

[22] Filed: Apr. 29, 1985

[51] Int. Cl.[4] ..... B32B 3/26; B32B 7/12; B32B 13/00

[52] U.S. Cl. ..... 428/314.4; 428/317.7; 428/318.4; 428/319.1; 428/703

[58] Field of Search ..... 428/312.4, 314.4, 314.8, 428/317.1, 317.7, 318.4, 319.7, 425.1, 703

[56] References Cited

U.S. PATENT DOCUMENTS 3,538,055 11/1970 Camilleri et al. ..... 428/425.1
4,315,967 2/1982 Prior et al. ..... 428/312.4

FOREIGN PATENT DOCUMENTS 2125140 9/1972 France ..... 428/319.1
918123 2/1963 United Kingdom ..... 428/312.4
941023 11/1963 United Kingdom ..... 428/312.4

*Primary Examiner*—William J. Van Balen
*Attorney, Agent, or Firm*—L. E. Hessenaur, Jr.

[57] ABSTRACT

A composite panel is provided primarily for roof deck construction comprising three sub-panels or strata. The first sub-panel comprises aspen wood fibers bonded with a magnesium oxysulfate inorganic cement and further including a sodium silicate binder. The second sub-panel comprises a foam plastic closed cell insulation, preferably polystyrene. The third sub-panel comprises a waferboard comprising wood chips bonded with a phenolic resin. The three sub-panels are bonded together with a urethane based adhesive.

4 Claims, 4 Drawing Figures

ROOF DECK COMPOSITE PANELS

BACKGROUND OF THE INVENTION

Roofs for buildings have many requirements. They must be waterproof to repel rain, snow, etc., they must be capable of supporting an external load, such as accumulated snow, and in most geographic areas they must also provide insulation either to prevent heat loss in winter climates, or to prevent ingress of heat into air conditioned buildings. In order to support sufficient loads it has been necessary to provide rather extensive framing. Built-up outer roof structures involving asphalt and a fabric are common in flat roofs, while slate surfaced asphaltic shingles are commonly used on sloping roofs. It is common practice to provide insulation beneath a roof. Conventional roof structures tend to be rather labor intensive, and hence expensive. Besides being expensive, labor intensive roofs tend to vary somewhat in quality in accordance with the skill of the workmen installing the roof.

There have been roof constructions made of laminated material including an insulator such as a foam plastic which have been less labor intensive than roofs that are built on the site from separate materials. However, such roofs have not always been fully satisfactory.

OBJECTS AND SUMMARY OF THE PRESENT INVENTION

It is an object of the present invention to provide a laminated roof structure which requires a minimum of labor for installation and which is sufficiently strong as to require a minimal sub-structure.

More particularly it is an object of the present invention to provide a laminated roof deck composite panel comprising a bottom layer of Tectum, a center layer of expanded closed cell polystyrene foam, and an outer or top layer of wafer-board sheathing. (Tectum is a proprietary material defined hereinafter).

In accordance with the present invention the roof deck composite panels herein provided are of light weight and are strong enough to present rather long spans. There is a nailable surface, and both excellent insulation values and excellent noise absorbing characteristics are provided. Being factory constructed the panels are of uniform quality. Tongue and groove or other suitable joint seals are provided to prevent thermal leaks. The interior or lower portion of the panel is of limited combustible construction and provides an attractive interior finish. Rapid, one-trade installation is afforded.

In particular, panels are provided consisting of a lower layer or stratum of Tectum material which is composed of aspen wood fibers bonded with an exclusive inorganic hydraulic cement, and sold by Tectum, Inc., of Newark, Ohio. It is formed by a continuous process under heat and pressure. The inorganic cement is magnesium oxysulfate with the addition of sodium silicate as a binder. The surface is silicone sprayed to provide a measure of water repellancy. To this stratum of Tectum material there is adhesively secured a layer or stratum of expanded polystyrene closed cell foam, of which STYROFOAM polystyrene foam sold by the Dow Chemical Company is a preferred example. Finally, the upper or outer layer or stratum comprises a conventional waferboard sheathing. The strata, layers or sub-panels are adhesively secured together by an ICBO (International Conference of Building Officials) acceptable, moisture resistant urethane based, structural grade laminating adhesive such as "Morad" adhesive by Morton Chemical Company of Chicago, Ill.

THE DRAWINGS

The invention will best be understood with reference to the following specification when taken in connection with the accompanying drawings wherein.

DETAILED DISCLOSURE OF THE ILLUSTRATED EMBODIMENT

Figure 1:
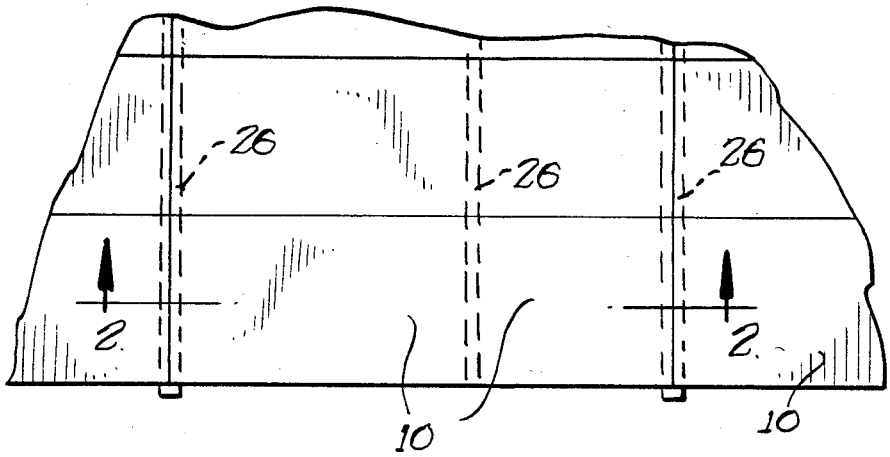
FIG. 1 is a fragmentary top view of a roof constructed with the panels of the present invention, before application of the outer waterproofing layer.
Figure 2:
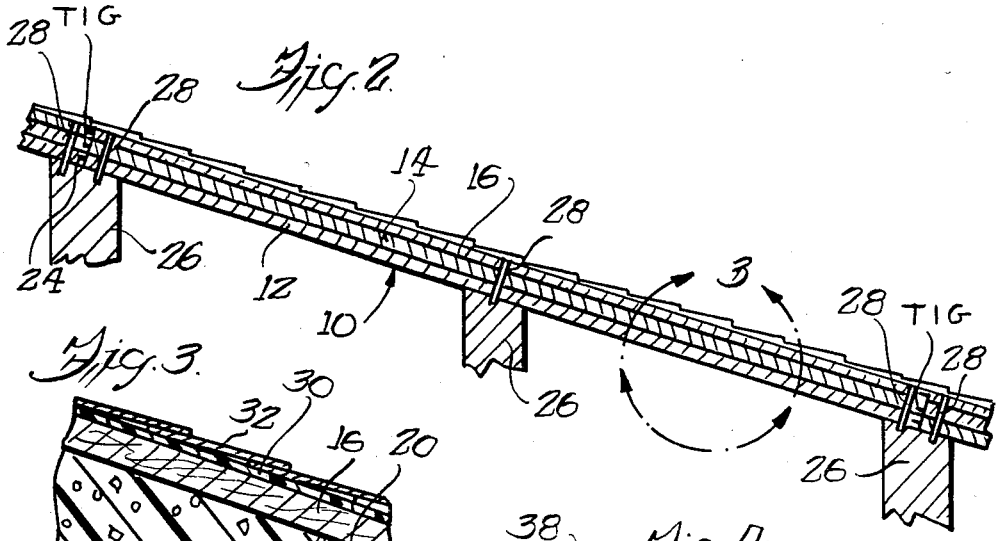
FIG. 2 is a cross-sectional view taken on an enlarged scale taken substantially along the line 2—2 of FIG. 1, and including the outer waterproofing layer.
Figure 3:
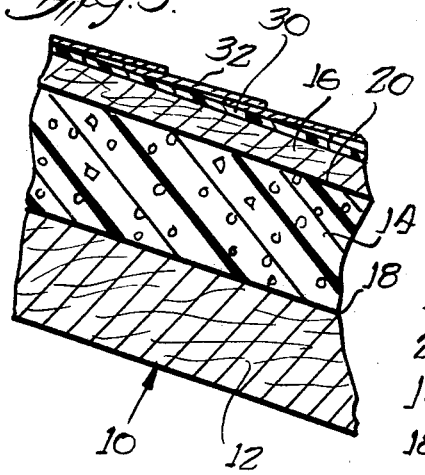
FIG. 3 is a detail sectional view on a larger scale taken within the circle 3 in FIG. 2.

Turning now in greater particularity to the drawings, and first to FIGS. 1–3, there will be seen a plurality of roof deck composite panels 10 each comprising three sub-panels or strata, the lowermost sub-panel 12 comprising Tectum, which as noted previously is composed of aspen wood fibers bonded with an exclusive inorganic hydraulic cement, and formed by a continuous process under heat and pressure. The inorganic cement is magnesium oxysulfate with the addition of sodium silicate as a binder. The outer surfaces are quite smooth due to the mechanical formation thereof, and the surfaces are silicone sprayed to provide a degree of water repellancy. The center sub-panel or stratum 14 comprises expanded polystyrene closed cell foam, and it previously has been noted that STYROFOAM polystyrene foam sold by the Dow Chemical Company is a preferred example. The upper or outer stratum or sub-panel 16 comprises a commercial grade of waferboard which comprises hardwood wafers bonded under heat and pressure with waterproof phenolic resin. The three strata or sub-panels are bonded together, respectively at 18 and 20 by an ICBO acceptable, moisture resistant urethane based structural grade laminating adhesive produced by Morton Chemical Company of Chicago.

The bottom layer (Tectum) is provided with a tongue and groove joint, while the top two layers simply butt together. Ship lap detail was planned but to date they just have a butt edge on the foam.

In a specific example the panels 10 are 4 feet wide by 12 feet long. The Tectum sub-panel 12 is 1:½ inches thick, the polysytrene foam sub-panel 14 is 1–12 inches thick, and the wafer board sub-panel 15 is 7/16 inch thick. The panels, as seen in FIGS. 1 and 2 are supported on wooden beams 26 spaced 6 feet apart. A single 12 foot panel thus spans a total of 3 beams. The roof deck composite panels disclosed herein are secured to the wood beams 26 by suitable means such as pole barn spikes driven through the panels along the edges thereof, and at the center thereof. The pole barn spikes penetrate the beams approximately 1–½ inch. The roof as illustrated in FIG. 1–3 is a pitched roof, and the outer surface thereof is covered with a layer of sheathing paper 30 (ig. 3) nailed by suitable short roofing nails to the outer waferboard sub-panel 16. The sheathing paper is topped by conventional asphalt shingles 32, also conventionally nailed to the outer-sub-panel 16 of waferboard.

Figure 4:
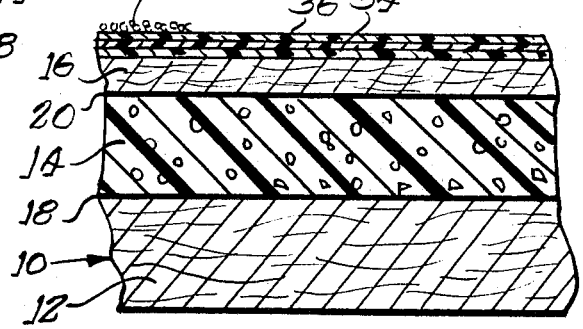
FIG. 4 is a view similar to FIG. 3 showing the panels of the present invention incorporated in a flat roof as opposed to the sloping roof of the previous figures.

A modification of use of the panels of the present invention is shown in FIG. 4. The panels are identical with those as previously described, and similar numerals are utilized to identify similar parts. The difference is that the panels are laid horizontally as a roof rather than inclined. The upper surface is waterproofed by the application of at least two layers 34 and 36 of sheathing paper or "tar" paper which are mopped on with asphalt or bitumin to provide a waterproof surface. A layer of ballast 38 such as pea gravel is laid over the built-up asphalt or bitumin roof to prevent deterioration thereof by ultraviolet radiation from the sun.

The panels as specifically described up to this point are lightweight, being on the order of 4.5 pounds per square foot. They are strong, and insulating, and water repellant. They provide an excellent base for various roofing systems available today, such as the shingles or the built-up asphalt or bitumin roof as disclosed. Other types of roof may be constructed with the present panels.

Although other forms of insulation may be used, the polystyrene foam disclosed has the advantage of a high flexural strength, and this allows the large span of 6 feet between beams or subperlins. The smooth flat surface of the polystyrene foam makes it possible to factory apply the waferboard and also the Tectum substrate, thus avoiding current labor intensive field application techniques.

As noted, longer spans are produced. The panels are of light weight. The outer surface is nailable, and also provides an approved surface for applying built-up roof surfaces adhesively. The panels have excellent insulation values and corresponding excellent noise absorbing characteristics. There is a uniform quality due to the factory assembling thereof. The tongue-in-groove seals of joints prevent thermal leaks and effictively lock one panel to another. The inner or lower stratum is of limited combustibility, and therefore provides a fire resistant roof. The interior finish is attractive to the eye and need not be further finished, although it is susceptible to painting without resorting to any unusual techniques. The panels can be laid-up in a roof quickly and nailed in place by a single trade.

Specific examples as to sizes have been set forth heretofore, and it will be understood that these are by way of specific example. Other exemplary parameters are as follows:

If the invention is a composition

| | | |
|---|---|---|
| 1. | Thickness = | panel 3½", 5" |
| | Wgt. PSF = | 4.4, 4.8, 5.0 |
| | R-value = | |
| | Heat flow up = | 11.92, 16.92, 19.42 |
| | Heat flow dn. = | 12.31, 17.31, 19.81 |
| | Widths = | 22½" and 46½" |
| | Lengths = | 3½" panel = 60, 72, 96, 120, 144 |
| | | 4" panel = 60, 72, 96, 120, 144 |
| | | 5" panel = 60, 72, 96, 120, 144 |
| | Max joist spacing | 3½" panel = 60" |
| | | 4" panel = 72" |
| | | 5" panel = 72" |
| | Design Load | 3½" panel = 50 PSF |
| | | 4" panel = 50 PSF |
| | | 5" panel = 60 PSF |
| | | Deflection = better than L/240 |

Although the panels as disclosed herein have specific and efficient use in roof construction it is contemplated that they could be used for other purposes such as walls or sheathing.

The specific example of the invention as herein shown and described is for illustrative purposes only. Various changes in structure will no doubt occur to those skilled in the art, and will be understood as forming a part of the present invention insofar as the fall within the spirit and scope of the appended claims.

The invention is claimed as follows:

1. A composite panel comprising a first sub-panel comprising wood fibers bonded with an inorganic cement comprising magnesium oxysulfate, a second sub-panel bonded to said first sub-panel and comprising a foam resinous plastic insulation, and a third sub-panel bonded to said second sub-panel and comprising a resin bonded wood product.

2. A composite panel as set forth in claim 1 wherein the fibers of said first sub-panel comprise wood fibers, and further including in said first sub-panel a sodium silicate binder.

3. A composite panel as set forth in claim 1 wherein said second sub-panel comprises a closed cell polystyrene foam insulation.

4. A composite panel as set forth in claim 1 and further including a sodium silicate binder, said second sub-panel comprising a closed cell polystyrene foam insulation, said third sub-panel comprising a waferboard, and said panels being bonded to one another by a urethane based adhesive.

* * * * *